US005277477A

United States Patent [19]

Sharff et al.

[11] Patent Number: 5,277,477

[45] Date of Patent: Jan. 11, 1994

[54] TRANSPORTER FOR THE PHYSICALLY IMPAIRED

[76] Inventors: Harold M. Sharff, 67 Victoria Heights, Hyde Park, Mass. 02136; Murray N. Markson, 12 Royce Rd., Framingham, Mass. 01701

[21] Appl. No.: 726,583

[22] Filed: Jul. 8, 1991

[51] Int. Cl.[5] ..... A47C 7/50

[52] U.S. Cl. ..... 297/423.21; 297/313; 297/338

[58] Field of Search ..... 297/313, 314, 338, 430–432; 297/434, 435;

[56] References Cited

U.S. PATENT DOCUMENTS

| | | | |
|---|---|---|---|
| 387,718 | 5/1863 | Watson et al. | 297/432 |
| 636,725 | 11/1899 | Healy | 297/431 |
| 1,284,459 | 7/1872 | Brennan | 297/434 |
| 1,310,581 | 7/1919 | Russo | 297/434 |
| 2,185,813 | 1/1940 | Johnson | 297/432 |
| 3,580,634 | 5/1971 | Bah | 297/313 |
| 4,358,156 | 11/1982 | Shartl | 297/432 X |
| 5,674,620 | 12/1990 | Jay et al. | 297/338 X |

FOREIGN PATENT DOCUMENTS

| | | | |
|---|---|---|---|
| 2139882 | 11/1984 | United Kingdom | 297/313 |

*Primary Examiner*—Peter R. Brown
*Attorney, Agent, or Firm*—Charles R. Fay

[57] ABSTRACT

A person transporter in the form of a chair having an open frame and a removable seat at a height above the knees of the average person so that it is easier to get into and out of, the seat being tiltable from a horizontal position either forward or back. A footrest in the lower part of the frame is movable from wholly housed in the frame to an exposed position for use, a vertical lever at the side of the frame for so moving the footrest, the lever being easily accessible to the attendant.

6 Claims, 5 Drawing Sheets

TRANSPORTER FOR THE PHYSICALLY IMPAIRED

BACKGROUND OF THE INVENTION

This invention is based on the structure disclosed in U.S. Pat. No. 4,358,156, dated Nov. 9, 1982, and also includes the wheeled seat that is above the level of the knees of the patient or invalid standing beside so that it is easier for this person to sit in it and rise from it plus a simple a foot rest. In the patent this footrest is operated by the attendant to move from an out-of-the-way location within the chair frame out to a position for the occupant to rest his feet. The present invention provides a simple means by which the attendant may operate the footrest.

In addition the seat of the transporter is capable of at least three different positions: horizontal, tilted slightly forward for still easier entrance and exit, or a rearward tilt for safer position of the occupant.

Both of these features are therapeutic because they reduce the stress on the involved muscles and joints, and this leads to better chances of cure for the patient. The well-known wheelchair requires the help of at least one, and often two attendants for both seating the patient, unfolding the footrest, and extracting the patient from the wheel chair. The transporter not only provides correct skeletal positioning for the patient but also reduces back injuries. to attendants caused by lifting of patients.

SUMMARY OF THE DISCLOSURE

The present transporter is in general very similar to that shown in the patent identified above, but the footrest in not pivoted with respect to the chair structure but slides in and out the same in a horizontal plane. A pivoted vertical handle is mounted on the chair structure handy for the attendant who merely unlocks the pivoted lever and swings the lever by the handle. The tilt seat is merely lifted out of it's position and repositioned to the situation wanted. This seat is merely a flat sheet of wood or metal, of seat size, with handling apertures at the sides by which to manipulate it. The seat is pivoted by pins that may be vertically adjusted, and adjustable stops support the seat fore and aft.

PREFERRED FORM OF THE INVENTION

Figure 1:
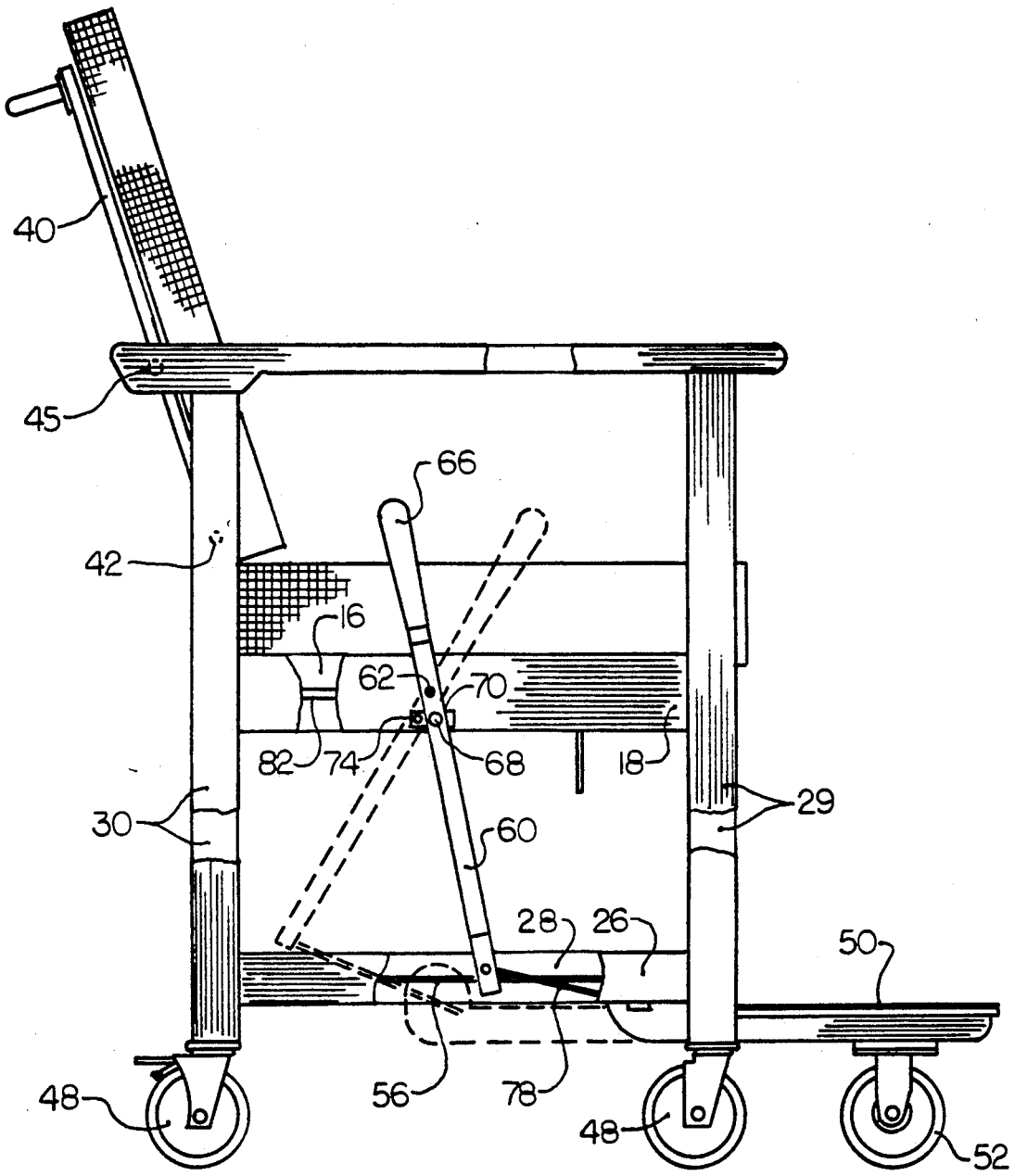
FIG. 1 is a view in side elevation of the new transporter-chair, parts in section.
Figure 2:
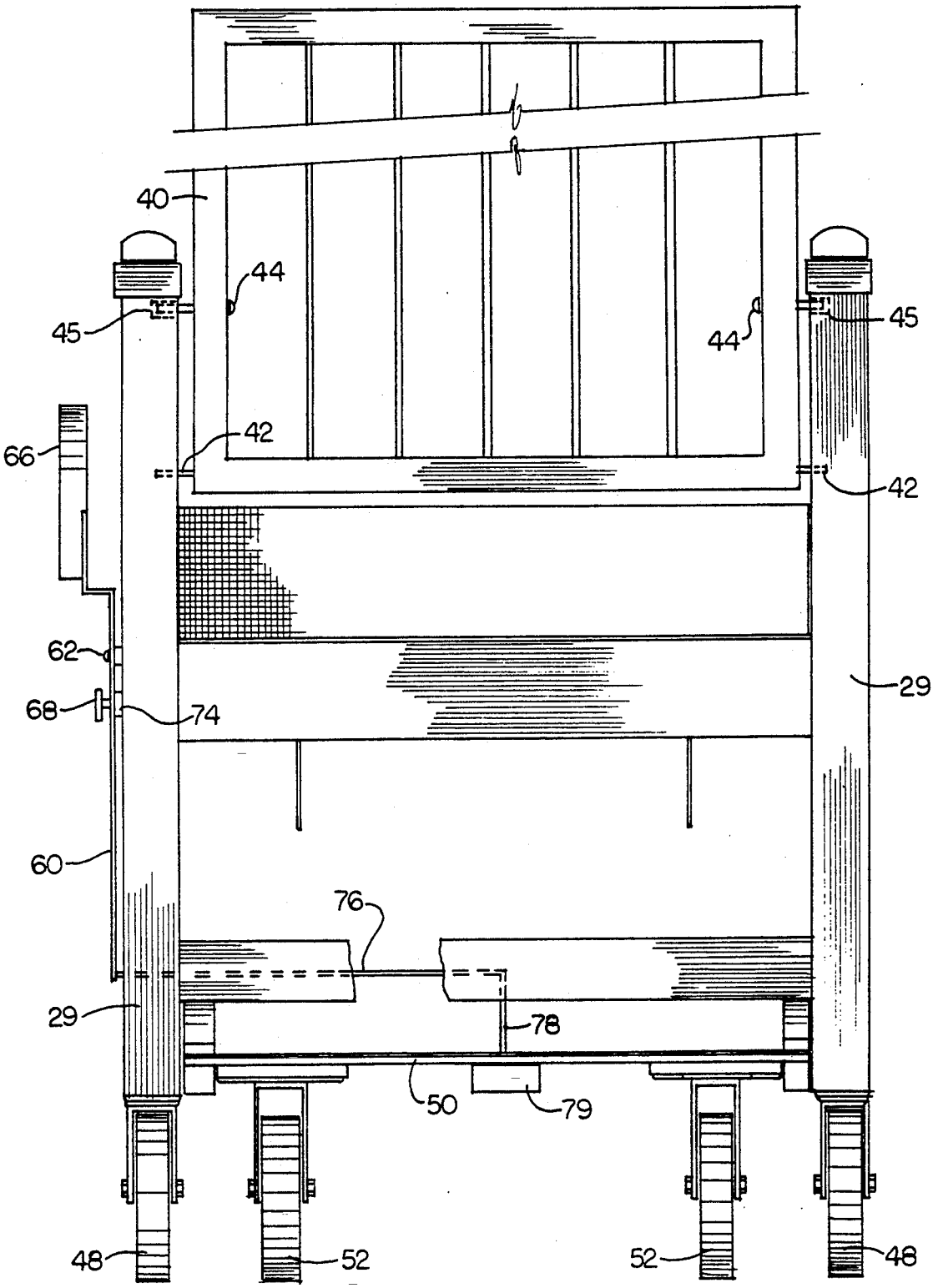
FIG. 2 is a front elevational view thereof, parts in section.
Figure 4:
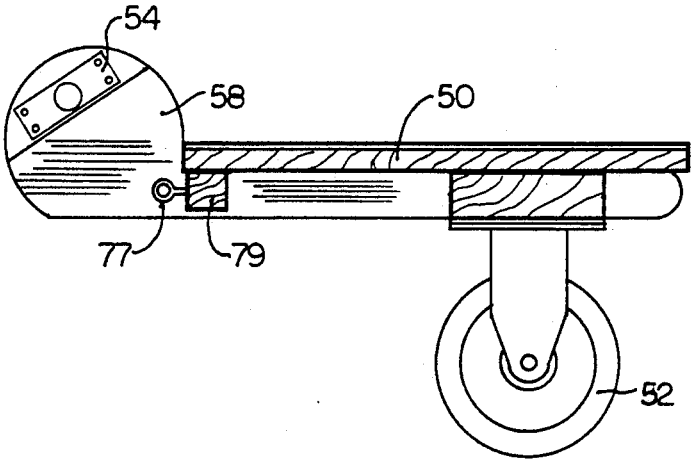
FIG. 4 is an elevational side view of the footrest.
Figure 3:
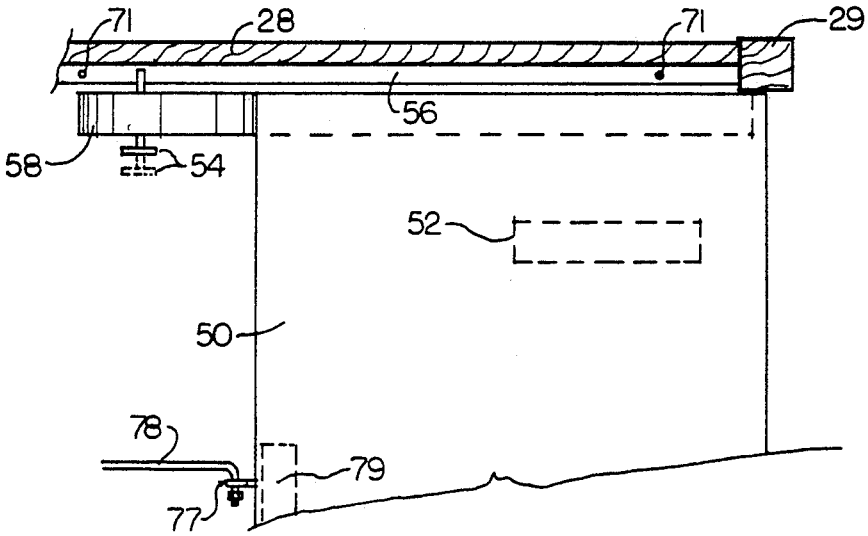
FIG. 3 is a partial top plan view of the footrest.
Figure 5:
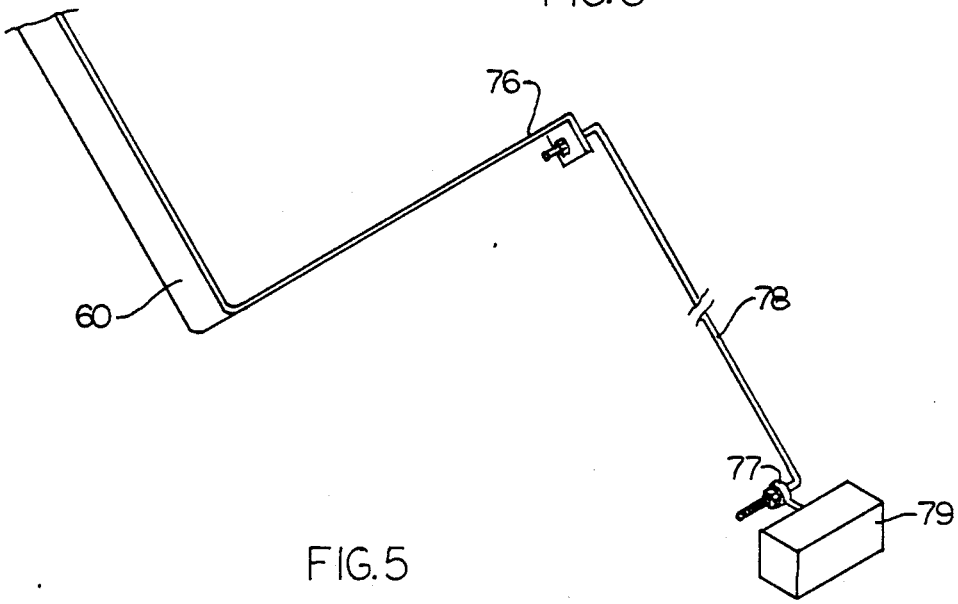
FIG. 5 is a partial perspective view of the footrest and its relation to the transporter.
Figure 6:
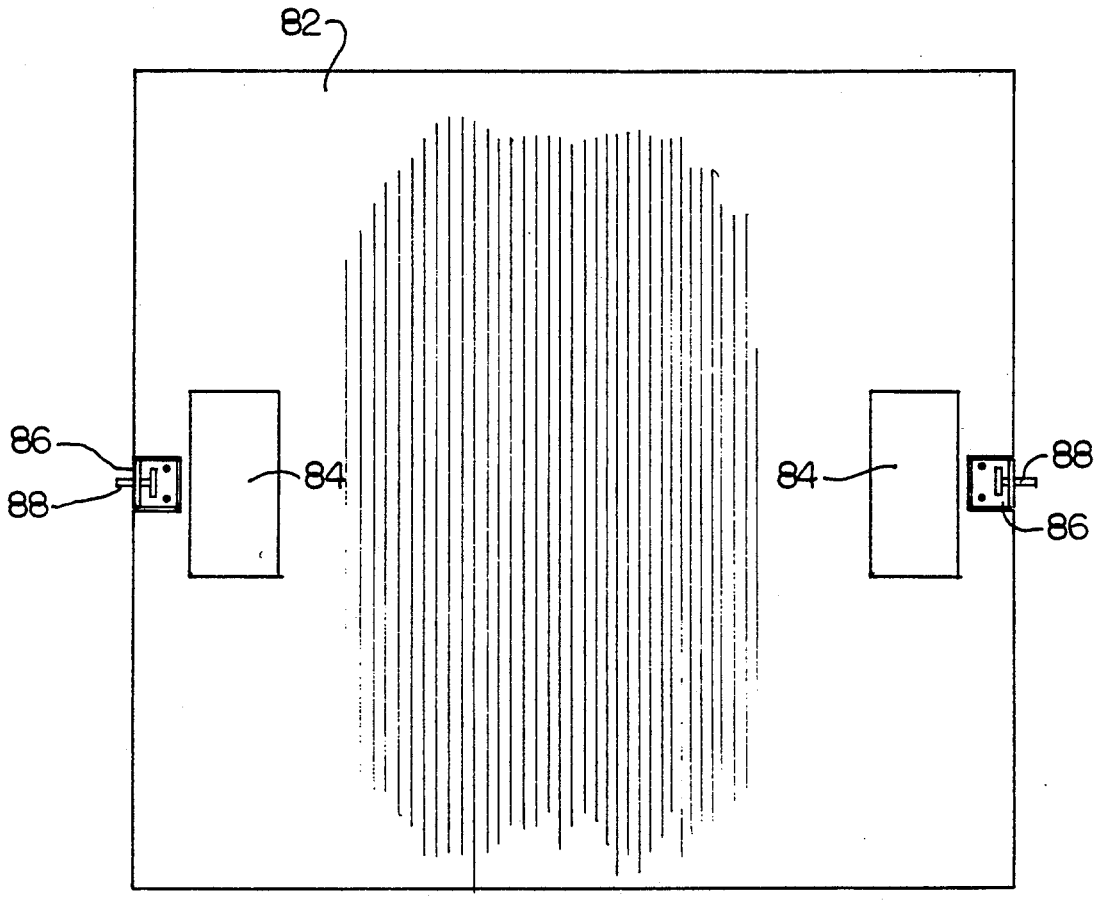
FIG. 6 is a bottom plan view of the seat.

The transporter of this invention is in the form of an open frame chair having a seat well above the knees of an average adult. The exact height of the seat is not important as long as it is enough to facilitate the entrance and exit of the patient or invalid, especially one with trouble with the knees, back, or the like. The general set-up is very similar to that of U.S. Pat. No. 4,358,156, dated Nov. 9, 1982. A selected number of front and rear members 30 are provided to connect front legs and rear legs to complete the frame, members 16 and 18 and 26 and 28 connecting the front legs to the rear legs.

A back 40 is rotarily adjustable on pins 42 and bushings 45, and locked in selected position by well-known retractable pins or even mere screws 44. This back 40 may also have a removable pad.

The frame (or chair) is provided with wheels 48 which are rotatable on a vertical as well as a horizontal axis like casters and have the usual latches to fix them in position when desired.

A horizontally in-and-out footrest 50 rides on its own wheels 52 and retractable pins 54 in elongated recesses 56 at the inside aspects of members 26 and 28 which may be located in blocks 58 attached to the footrest, or at the side edge thereof.

Thus, the pins not only help to support the footrest with wheels or casters 52, but upon being retracted they are used for assembly of the footrest to the chair frame.

A lever 60 pivoted at 62 to member 18 as by a nut and bolt, and has a handle 66 at its upper end. This lever is swingable on a horizontal axis backwards and forwardly between stop pins. It may also be provided with a retractable pin at 68. This pin is for entering one of the recesses 70, in a plate 74 on member 18 and locks the lever in either the solid line or dotted line position in FIG. 1, thereby locking the attached footrest in a, non-useful but housed position or out, useful position.

The lever is attached to the rear or inward edge portion of the footrest by an inwardly extending portion 76 of the lever at its lower end, and a loosely pivoted link 78 and screw eye 77 from the inward end portion of the lever extension, and thus the motion of the lever is imparted to the footrest for moving and locking the same. The lever and its axis are preferably so proportioned as to move the footrest to a greater extent than the handle is moved.

Figure 7:
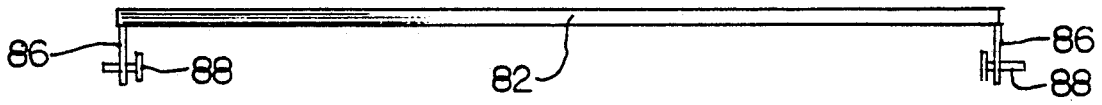
FIG. 7 is a front elevational view of the seat.
Figure 8:
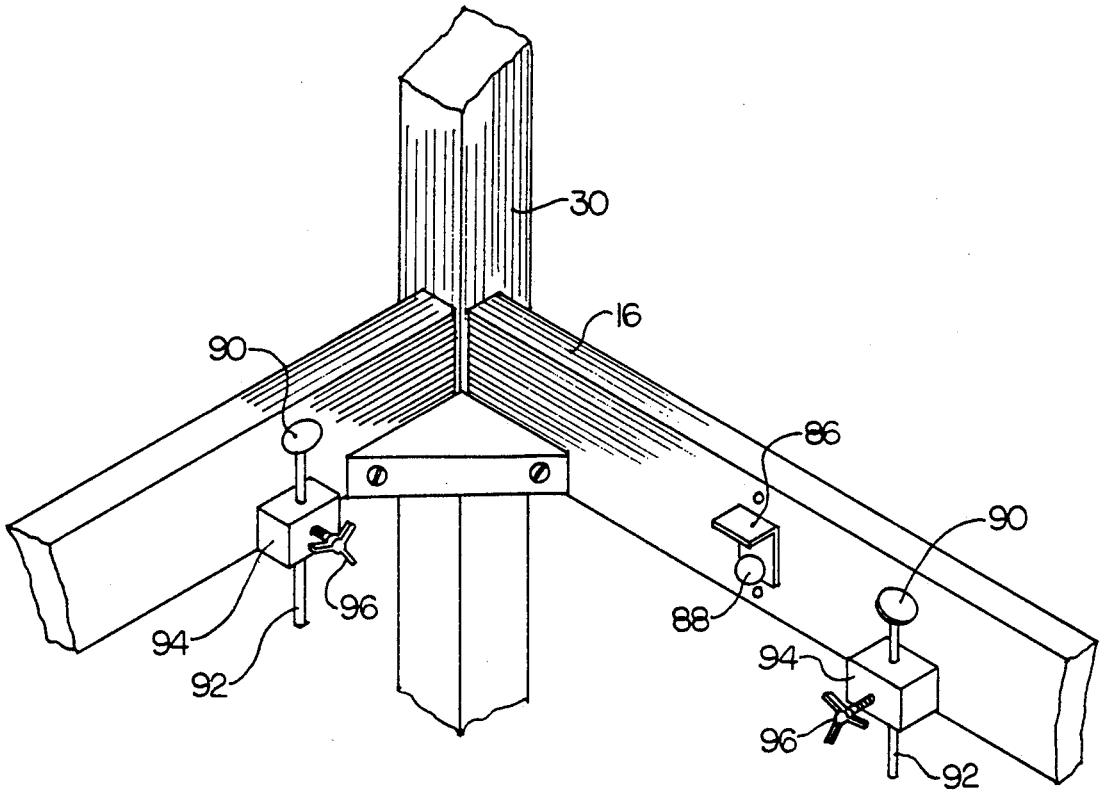
FIG. 8 is a partial perspective view of a part of the seat support.
Figure 9:
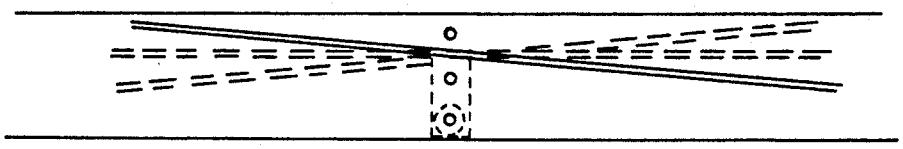
FIG. 9 is a diagram illustrating the seat tilt.

The seat is a generally square flat thin sheet of wood or other suitable material 82. It has hand or access holes 84 at the opposite edges on its lower side, and there is a bracket 86 and retractable pins 88 thereon adjacent each access hole. These pins mount the seat for pivot action on an axis across the chair frame and parallel to the front and rear edges of the seat. The pins are received in a selected recess in a vertical series of recesses at the inner aspect of chair members 16 and 18, as shown in FIG. 7.

There are four supports for the seat adjacent the corners thereof, and the seat is thus supported at six points. The front and rear supports each comprise a stop 90, preferably rubber, on the upper end of a vertical rod 92, slidable in bracket 94, and locked in vertical selected position by a screw clamp 96. These supports are set to the elevation wanted for a horizontal seat, or selectively elevated at the front of the seat or at the back of the seat. Some patients will want to have the seat easier to get on and off of, so the seat should be raised at the back, and others will want a somewhat safer seat, in which case it should be raised at the front edge.

The high-seat E-Z Up Artherapedic Transporter was developed as the result of a long standing need of hospital staff for a better way to transport orthopedic patients to various departments within the facility while maintaining correct anatomical positioning.

The adjustable features allow for controlling seat height, seat depth, hip and knee flexion and pressures on the lumbosacral area thereby reducing potential damage to corrective procedures.

Now, it is easy to get a patient in and out safely, with a minimum of lifting and provide added comfort and proper skeletal positioning that is so necessary while a patient is being transported or just sitting.

Another significant benefit provided by the transporter is that less lifting of patients is required thereby reducing the amount of back injuries to the staff.

The footrest retracts under the seat to enable patients to enter and exit safely and easily. The lever operates and locks automatically the footrest in either the extended or retracted position.

The transporter is equipped with swivel mounted, non-marking rubber tread, ball bearing wheels. The rear wheels have foot operated brakes which lock the wheel and swivel simultaneously. The footrest has two fixed wheels which provide for easy movement and maneuverability.

Patients with indications such as hip/knee joint replacements, arthritis, geriatrics, stroke, M.S., Parkinson's Disease, degenerative disc disease or those who have undergone back surgery can obtain significant benefits from its use of the transporter.

We claim:

1. A transporter for physically impaired persons comprising front and rear legs, elements connecting the legs forming a frame, a seat member in said frame, a footrest, means in the frame slidably guiding the footrest to move in a fore and aft direction from a housed, out of use position in the frame to an exposed use position outside the frame, a lever having ends and pivoted on said frame between said ends for swinging motion in a vertical plane, the lever extending from a point convenient to the hand of an occupant of the transporter downwardly to a point adjacent the footrest, a connection between said footrest and the lower end of the lever whereby the lever moves the footrest in and out of the frame, and latching means on the frame holding the footrest selectively in use and no-use positions, projections at the opposite side edges of the footrest adjacent the rear edge thereof, certain of said frame elements having parallel grooves that run fore and aft of the transporter, said grooves facing each other, said one of said projections located in each groove and wheels on the underside of the footrest adjacent the front edge of the footrest, and said projections being retractable to free the footrest from the frame.

2. The transporter of claim 1 including a pivot connection for the seat on the frame, the axis of the pivot connection being parallel to the front edge of the seat, the pivot connection comprising spring biassed pins mounted at the underside of the seat between the front and rear edges of the seat means in its frame receiving the pins selectively the seat being otherwise unconnected to the transporter said last named means and said pins to provide tilting of the seat fore and aft on a transverse axis.

3. The transporter of claim 2 including a plurality of vertically arranged openings in the frame elements carrying the seat, for selective entry of the seat pins therein for adjustment of the seat in a vertical direction.

4. The transporter of claim 3 including stops mounted on the frame to support the seat fore and aft.

5. The transporter of claim 4 including means to vertically adjust said stops to cooperate with the vertical adjustment of the seat by the pins.

6. A transporter for invalids and patients, said transporter being in the form of a chair comprising an open frame, said frame comprising front, side, and rear members and a seat, said seat being flat and removable, retractable pins located at opposing edges at the underside of said seat, recesses in the frame receiving the pins whereby the pins form an axis about which the seat is tiltably movable relative to the frame, apertures in the seat adjacent the pins for access thereto from above the seat for grasping the seat to remove it, a plurality of vertically adjustable stops on the frame to support the seat, said seat being tiltable selectively between horizontal position, or positions tilted either way on the pins, said stops being adjustable to support the seat in the position desired, and a series of vertically arranged recesses are provided on the frame to selectively receive the pins on the seat to vertically adjust the height of the seat.

* * * * *